United States Patent [19]

Deffayet

[11] Patent Number: 5,005,483

[45] Date of Patent: Apr. 9, 1991

[54] METHOD FOR THE EJECTION OF SUB-MUNITIONS AND PROJECTILE APPLYING SAID METHOD

[75] Inventor: Jean Deffayet, Chaville, France

[73] Assignee: Thomson-Brandt Armements, Boulogne Billancourt, France

[21] Appl. No.: 362,661

[22] Filed: Jun. 7, 1989

[30] Foreign Application Priority Data

Jun. 10, 1988 [FR] France ..... 88 07767

[51] Int. Cl.[5] ..... F42B 12/58

[52] U.S. Cl. ..... 102/489; 102/357; 102/517

[58] Field of Search ..... 102/340, 342, 351, 357, 102/393, 489, 505, 517

[56] References Cited

U.S. PATENT DOCUMENTS

| | | | |
|---|---|---|---|
| 2,972,946 | 2/1961 | Poulter | 102/393 |
| 3,064,575 | 11/1962 | Schermuly . | |
| 4,682,546 | 7/1987 | Chovich | 102/517 |
| 4,777,882 | 10/1988 | Dieval | 102/489 |

FOREIGN PATENT DOCUMENTS

| | | | |
|---|---|---|---|
| 0233833 | 8/1987 | European Pat. Off. . | |
| 0270401 | 6/1988 | European Pat. Off. . | |
| 1468281 | 2/1967 | France . | |
| 924690 | 5/1963 | United Kingdom | 102/357 |

*Primary Examiner*—Harold J. Tudor

*Attorney, Agent, or Firm*—Oblon, Spivak, McClelland, Maier & Neustadt

[57] ABSTRACT

Disclosed are a method for the ejection of sub-munitions from a projectile with null or low inherent rolling speed as well as a projectile fitted out with means enabling this method to be applied. The front part of the projectile is separated from the rear part by the shifting of a piston in a tube under the action of a pyrotechnical charge. The combination, at this piston and this tube, of grooves, working together with indentations or with a rotating band, creates a rolling motion that is sufficient to communicate an ejection speed, perpendicular to the axis of the projectile, to the sub-munitions.

5 Claims, 4 Drawing Sheets

METHOD FOR THE EJECTION OF SUB-MUNITIONS AND PROJECTILE APPLYING SAID METHOD

BACKGROUND OF THE INVENTION

1. Field of the Invention

The invention concerns a method for the ejection of sub-munitions from a projectile with little or no inherent rolling speed. It also concerns a projectile fitted out with means enabling this method to be applied.

The term "projectile" is taken to mean any carrier that is launched by a gun, by means of self-propulsion, by an aircraft etc., and follows a ballistic or corrected trajectory or path. The invention more precisely concerns projectiles having sub-munitions that are ejected at a given instant on the trajectory of the carrier projectile.

2. Description of the Prior Art

It is generally sought, in projectiles with sub-munitions, to achieve the lateral and axial spreading of their contents, so as to obtain optimum dispersal without resorting to the firing of many projectiles, called "cargo" which are often very expensive in terms of unit cost. This problem is resolved with relative ease when the projectile has sufficient rolling speed. It is then possible to use this rotation to give the sub-munitions a speed of removal, perpendicular to the trajectory, that causes lateral dispersal of the points of impact.

On the other hand, when the carrier cannot have sufficient inherent rolling speed, for example, because of problems related to detection or control, it is most usually necessary to use systems such as inflatable bags, pistons, pyrotechnical means, springs etc.

Another approach consists of the generation of a rolling motion in the final stage of the trajectory, slightly before the ejection sequence. There are many possible means, such as deflection, etc. All these methods have the drawback of being specific to the desired effect and of, therefore, entailing additional bulk, weight and considerable cost.

SUMMARY OF THE INVENTION

The present invention has the object of at overcoming these drawbacks. It concerns a new method for the ejection of sub-munitions from a projectile, the inherent rolling speed of which is practically null, a method which has the advantage of being part of the carrier-opening sequence itself, without its being necessary to resort to additional means that are heavy, bulky and costly.

The invention more precisely concerns a method for the ejection of sub-munitions from a projectile that carries them, said projectile comprising:

firstly, a casing that ends in a nose forming a front part, said part being locked by locking means to a rear part called a base;

secondly, a rod that moves within a tube to act as a piston under the effect of a pyrotechnical charge in order to separate the rear part from the front part; wherein said method comprises, after the unlocking of the locking means and the firing of the pyrotechnical charge, in making the front part of the projectile rotate with respect to the rear part of said projectile, the sub-munitions being connected to the rear part by holding means, through the combination of grooves made on one of the parts of the projectile working together with a rotating band which itself has grooves and is solidly joined to the other part, to give each of the sub-munitions an initial transversal speed (v) making it possible to obtain an optimum dispersal of the sub-munitions.

BRIEF DESCRIPTION OF THE DRAWINGS

Various other objects, feature and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF PREFERRED EMBODIMENTS

Figure 1:
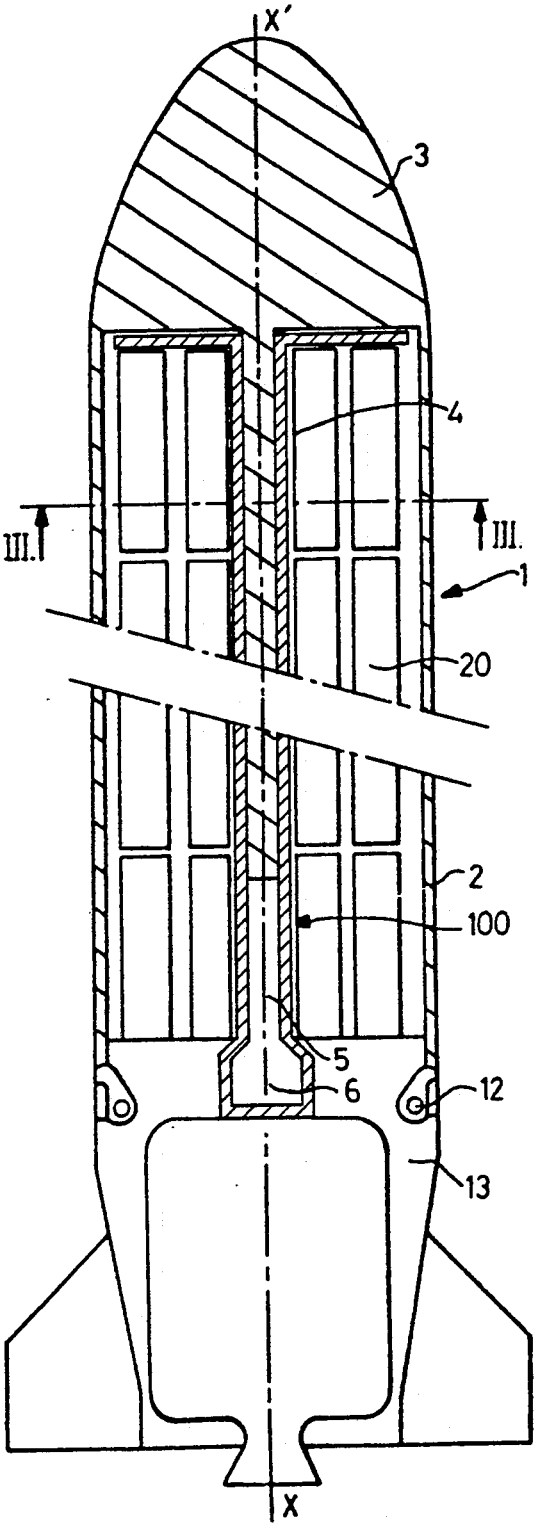
FIG. 1 gives a schematic view of an alternative embodiment of a projectile capable of applying the method, according to the invention, for the ejection of sub-munitions.
Figure 2:
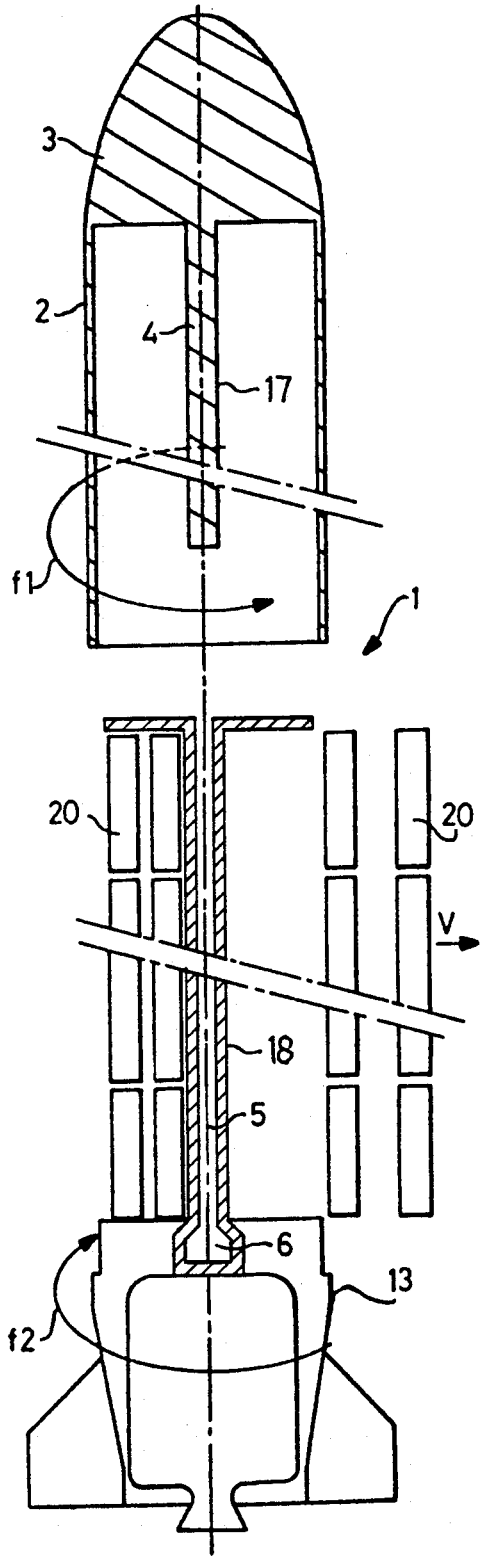
FIG. 2 illustrates the ejection stage itself.

As shown in FIGS. 1-5, which is complemented by FIG. 2 representing the projectile of FIG. 1 in a configuration corresponding to the ejection of the sub-munitions, this projectile (1) according to the invention has a casing (2) which is generally cylindrical and ends in a nose (3).

This nose (3) is itself solidly joined to an axial rod (4) designed, as shall be explained further below, to play the role of a piston. The rod (4) penetrates a tube (5) solidly joined to the rear part (the base 13) of the projectile (1), leaving, at the end, a free space occupied by a pyrotechnical charge 6.

According to an important characteristic of the invention, the tube (5) has grooves (18) and the rod (4) has a rotating band or machined indentations 177. The combination (100) of the tube grooves and a rotating band or indentations is symbolized, for clarity's sake, by a heavy line in the figure. This combination, in accordance with the invention, induces a rotational motion. It enables the implementing of the method for ejecting the sub-munitions (20) contained in the projectile (1). For, when the sub-munitions (20) have to be released, the firing of the pyrotechnical charge is initiated, it being seen to it that the means (12) for solidly joining the base (13) to the casing (2) are unlocked beforehand or simultaneously.

The rod (4) fulfils its piston function and, as shown in FIG. 2, ejects the nose (3). This ejection takes place with a rotational motion in a given direction (arrow fl) for the front part of the projectile and in an opposite direction (arrow f2) for the rear part.

The pitch of the grooves is chosen so as to obtain a rolling speed for the rear part that results in an optimum transversal ejection speed (v) for the sub-munitions (20) depending on their initial distance from the axis (xx') of the projectile (1).

Figure 3:
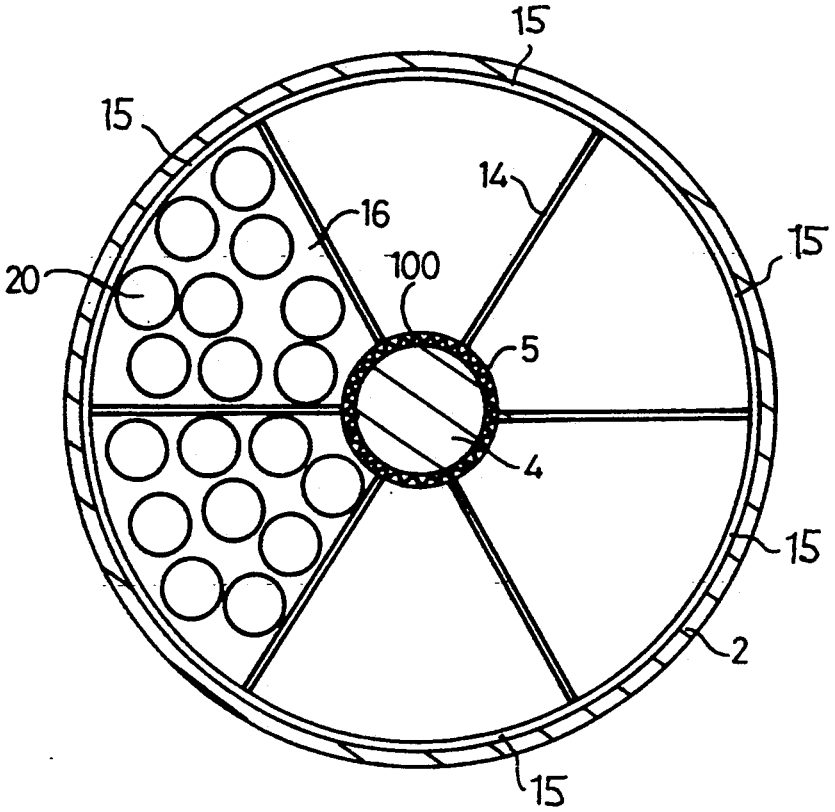
FIG. 3 shows a cross-section III—III of a projectile according to the invention.

As shown in FIG. 3, which is a cross-section view taken along line III—III of the projectile of FIG. 1, this projectile has the casing (2) solidly joined to the axial rod (4) which penetrates the grooved tube (5) through the combination 100 as described above. To this tube (5)

are fixed, for example, elements (14), which are metallic for example, so as to create compartments (16) within which the sub-munitions (20) are positioned. The set of sub-munitions (20) is held in each compartment by holding means, for example a band (15) controlled, for example, by an explosive system (not shown) which solidly joins all the sub-munitions to the tube (5). These holding means are generally unlocked when the unit consisting of the sub-munitions (20) and the tube (5) has reached a maximum speed which is the initial speed of the sub-munitions (20) after ejection of the nose (3), but their unlocking can be deferred and can be done for each compartment separately.

Figure 4:
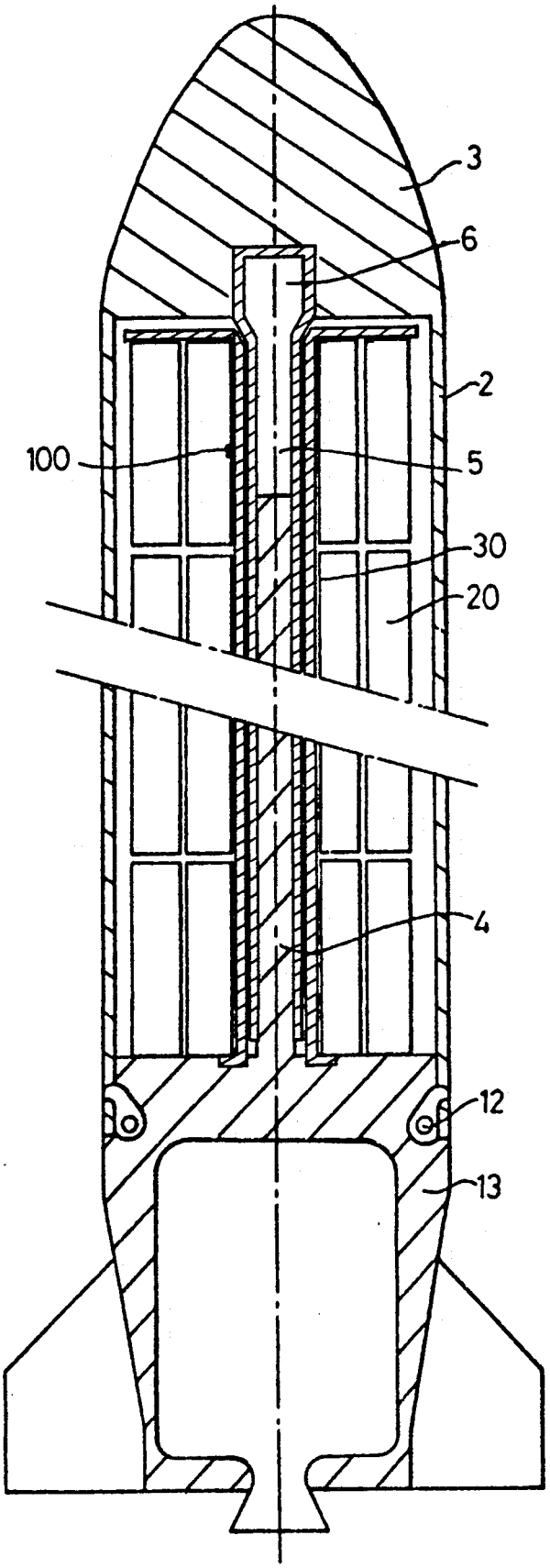
FIG. 4 gives a schematic view of another alternative embodiment of a projectile according to the invention.
Figure 5:
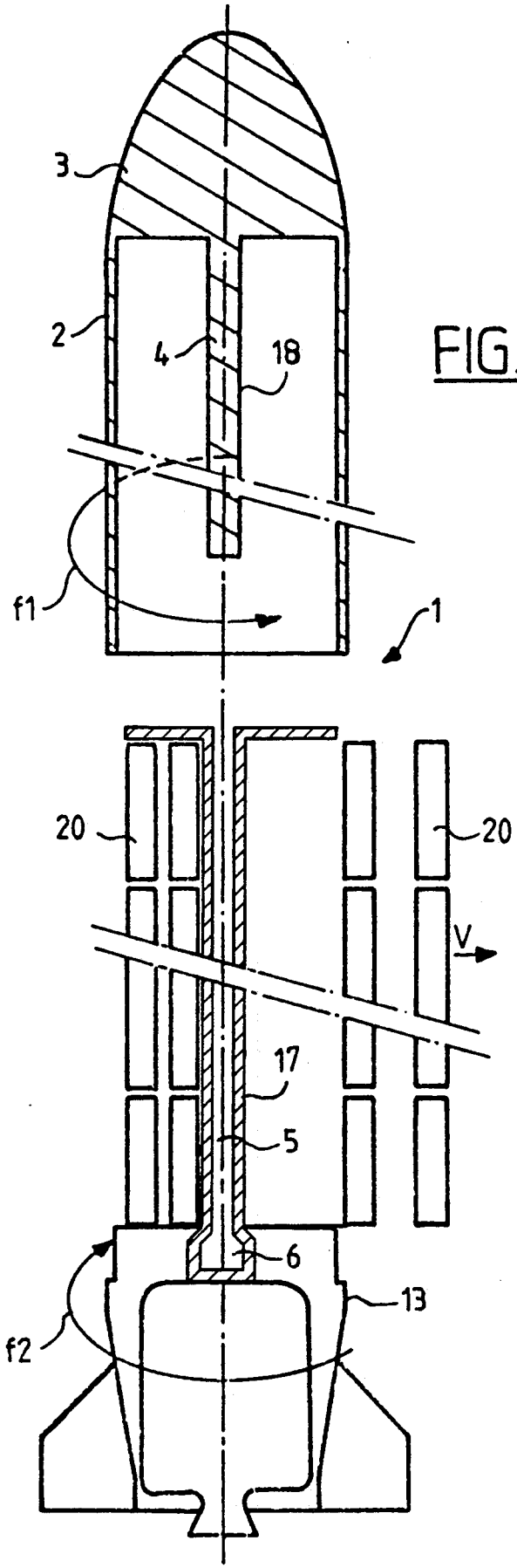
FIG. 5 illustrates an alternate embodiment.

As shown in FIG. 4, which illustrates an alternative embodiment of the invention, a converse architecture is achieved. The rod (4), acting as a piston, is now solidly joined to the base (13). The tube(5)and the chamber(-6)are then solidly joined to the nose (3).

In both these alternative embodiments, it is the tube (5) that is grooved, but one approach consists in making external grooves on the piston. In this case, the rotating band or the indentations are then located on the internal part of the mouth of the tube.

In the alternative where the tube (5) is solidly joined to the rear and the piston (4) is solidly joined to the front, the sub-munitions (20) are connected to the tube (5) (FIG. 1).

In the alternative where the piston (4) is at the rear and the tube (5) is at the front, the sub-munitions (20) are connected to the rear part, namely to the base (13) by any known means (30).

Irrespectively of the alternative that is chosen, there is thus obtained, at the instant of release of the sub-munitions, a rolling speed that communicates a transversal ejection speed to the sub-munitions.

An example of the rolling speeds achieved is given below:

Mass : front part 50 kg. rear part 350 kg.

Axial inertias : front part $I_1=1.13m^2$ kg. rear part $I_2=1.97\ m^2$ kg.

Piston diameter : 30 mm.

Piston length : 1.70 m.

Mean pressure : 500 bars.

Angle of groove : 5°

Separation speed: 45 $ms^{-1}$. Nose/base rolling speed : 45 rps Rear part rolling speed : 16.4 rps The latter speed must be added to the initial rolling speed cf the carrier, if this speed exists. If this speed is 10 revolutions per second, and if the sub-munitions are placed between 54 mm. and 120 mm. of the axis (xx') of the projectile, then the speeds of ejection perpendicular to this axis are between 9 and 20 $ms^{-1}$.

The sub-munitions may be released immediately, i.e. as soon as the casing uncovers the concerned section. It may also be deferred and the sub-munitions may be retained, for example, by a collar which is unlocked at the optimum moment after the casing has moved away.

Obviously, numerous modifications and variations of the present invention are possible in light of the above teachings. It is therefore to be understood that within the scope of the appended claims, the invention may be practiced otherwise than as specifically described herein.

What is claimed is:

1. A method for the ejection of sub-munitions from a projectile that carries them, which comprises:

connecting a casing to a nose forming a front part of said projectile, and connecting said front part by locking means to a rear part forming a base portion of said projectile;

positioning a tube in said casing connected to one of said nose and said base portion;

positioning a rod connected to the other of said nose and said base portion within said tube so as to act as a piston under the effect of a pyrotechnical charge in order to separate the rear part from the front part;

unlocking said locking means;

firing the pyrotechnical charge so as to rotate the front part of the projectile with respect to the base portion of said projectile through the combination of grooves formed on one of said tube and said rod in cooperation with a rotating band which is located on the other of said tube and said rod wherein, upon firing the pyrotechnical charge, an initial transversal speed for each of the sub-munitions is generated so as to generate a controlled transversal speed to each of the sub-munitions in one direction by rotation in one direction of the nose and rotation in an opposed direction of the base portion as to obtain an optimum dispersal of the sub-munitions, and holding the sub-munitions to the rear part by a holding band which surrounds said sub-munitions.

2. A projectile for the ejection of sub-munitions from a projectile carrying said sub-munitions, wherein said projectile comprises:

a nose portion forming a front part of said projectile;

a casing connected to said nose portion;

locking means for locking said front part to a rear part of said projectile forming a base portion of said projectile;

a tube positioned in said casing and connected to one of said nose portion and said base portion;

a rod connected to the other of said nose portion and said base portion and movably mounted within said tube so as to act as a piston under the effect of a pyrotechnical charge so as to separate the rear part from the front part of said projectile;

means for unlocking said locking means;

means for firing said pyrotechnical charge so as to rotate the front part of the projectile with respect to the rear part of said projectile by means of grooves formed on one of said tube and said rod in cooperation with a rotating band on the other of said tube and said rod such that, upon firing of said pyrotechnical charge, an initial transversal speed is generated so as to generate a controlled transversal speed to each of the sub-munitions in one direction by rotation in one direction of the nose and rotation in an opposed direction of the base portion so as to obtain an optimum dispersal of the sub-munitions; and holding means for joining the sub-munitions to the rear part, said holding means including a holding band surrounding said submunitions.

3. A projectile according to claim 2, wherein the rod is connected to the nose portion, the tube is connected to the base portion, the grooves are formed on the tube and the rotating band is provided on the rod.

4. A projectile according to claim 2, wherein the tube is connected to the nose portion, the rod is connected to the base portion, the grooves are formed on said tube and the rotating band is provided on the rod.

5. A projectile according to claim 2, wherein the grooves are formed on the rod and the rotating band is located on an internal part of the tube.

* * * * *